US010442227B2

(12) United States Patent
Huang et al.

(10) Patent No.: US 10,442,227 B2
(45) Date of Patent: Oct. 15, 2019

(54) STALLING OPERATION OF IMAGING DEVICES

(71) Applicant: HEWLETT-PACKARD DEVELOPMENT COMPANY, L.P., Houston, TX (US)

(72) Inventors: Xiao-Xi Huang, Singapore (SG); Vincent L-H Ong, Singapore (SG); Hua Zhou, Shanghai (CN)

(73) Assignee: Hewlett-Packard Development Company, L.P., Spring, TX (US)

( * ) Notice: Subject to any disclaimer, the term of this patent is extended or adjusted under 35 U.S.C. 154(b) by 6 days.

(21) Appl. No.: 15/571,002

(22) PCT Filed: Jul. 31, 2015

(86) PCT No.: PCT/CN2015/085749
§ 371 (c)(1),
(2) Date: Oct. 31, 2017

(87) PCT Pub. No.: WO2017/020179
PCT Pub. Date: Feb. 9, 2017

(65) Prior Publication Data

US 2018/0162152 A1 Jun. 14, 2018

(51) Int. Cl.
*B41J 29/38* (2006.01)
*B41J 13/00* (2006.01)
(Continued)

(52) U.S. Cl.
CPC ..... *B41J 29/38* (2013.01); *B41J 11/006* (2013.01); *B41J 13/0018* (2013.01); *B41J 29/02* (2013.01);
(Continued)

(58) Field of Classification Search
CPC ..... B41J 13/103; B41J 23/025; B41J 11/485; B41J 11/0005; B41J 11/48; B41J 11/50;
(Continued)

(56) References Cited

U.S. PATENT DOCUMENTS 4,909,649 A * 3/1990 Okunomiya ..... B41J 2/325 400/185
5,118,090 A * 6/1992 Sonoda ..... B41J 13/10 271/10.13
(Continued)

FOREIGN PATENT DOCUMENTS

CN 1537799 10/2004
CN 102566382 7/2012
(Continued)

*Primary Examiner* — Negussie Worku
(74) *Attorney, Agent, or Firm* — HP Inc. Patent Department

(57) ABSTRACT

Examples of stalling of operation of imaging devices are described herein. In an example, the imaging device includes an input roller assembly to transport a medium in the imaging device and a line feed roller assembly disengagably coupled to the input roller assembly to selectively drive the input roller assembly. To stall the operation of the imaging device, a line feed shaft of the line feed roller assembly can be automatically disengaged from the input roller assembly to discontinue advance of the medium along a print path.

15 Claims, 10 Drawing Sheets

(51) Int. Cl.

| | |
|---|---|
| ***B65H 5/06*** | (2006.01) |
| ***B65H 7/06*** | (2006.01) |
| ***B41J 29/02*** | (2006.01) |
| ***B65H 3/06*** | (2006.01) |
| ***B41J 11/00*** | (2006.01) |

(52) U.S. Cl.
CPC ..... *B65H 3/0669* (2013.01); *B65H 5/062* (2013.01); *B65H 7/06* (2013.01); *B65H 2403/42* (2013.01); *B65H 2403/422* (2013.01); *B65H 2403/70* (2013.01); *B65H 2403/722* (2013.01); *B65H 2404/1531* (2013.01); *B65H 2511/20* (2013.01); *B65H 2511/528* (2013.01); *B65H 2513/412* (2013.01); *B65H 2553/51* (2013.01); *B65H 2701/1311* (2013.01); *B65H 2801/12* (2013.01)

(58) Field of Classification Search
CPC . B41J 13/106; B41J 32/00; B41J 33/52; B41J 3/4075; H04N 1/00567; H04N 1/0057; H04N 1/00588; H04N 1/00591; H04N 1/00596; H04N 1/00602; H04N 1/0062; H04N 1/00623; H04N 1/00628; H04N 1/12; H04N 1/193
USPC ..... 271/10.13, 117, 114, 273, 10.04, 10.12, 271/11, 110, 118, 125, 126, 127, 147, 271/198, 213, 265.01, 274, 275, 34, 9.01, 271/9.05, 9.06, 9.08, 9.1, 9.11; 358/296
See application file for complete search history.

(56) References Cited

U.S. PATENT DOCUMENTS

| | | | | |
|---|---|---|---|---|
| 5,141,346 | A * | 8/1992 | Nakagawa | B41J 11/48 271/110 |
| 5,710,634 | A * | 1/1998 | Kuriyama | H04N 1/00572 347/3 |
| 7,726,650 | B2 * | 6/2010 | Tu | H04N 1/0057 271/273 |
| 8,002,278 | B2 | 8/2011 | Tsao | |
| 2001/0054787 | A1 * | 12/2001 | Yamagishi | B65H 5/062 271/3.17 |
| 2004/0101321 | A1 | 5/2004 | Alegria et al. | |
| 2004/0109189 | A1 * | 6/2004 | Ikeda | H04N 1/0057 358/1.13 |
| 2006/0082050 | A1 | 4/2006 | Wanibuchi et al. | |
| 2006/0153595 | A1 * | 7/2006 | Yoon | G03G 15/0121 399/228 |
| 2007/0273081 | A1 * | 11/2007 | Sonoda | B65H 3/0669 271/114 |
| 2010/0032887 | A1 * | 2/2010 | Morinaga | B65H 3/0661 271/10.12 |
| 2013/0049294 | A1 * | 2/2013 | Takano | B65H 85/00 271/225 |
| 2013/0140761 | A1 * | 6/2013 | Uchino | B41J 13/103 271/117 |
| 2014/0061998 | A1 * | 3/2014 | Kasashima | B65H 5/06 271/10.11 |
| 2015/0061219 | A1 * | 3/2015 | Murakami | B65H 1/14 271/272 |
| 2015/0212466 | A1 * | 7/2015 | Fukunaga | G03G 15/2064 399/122 |
| 2016/0152426 | A1 * | 6/2016 | Hosohara | B65H 3/5261 271/117 |

FOREIGN PATENT DOCUMENTS

| | | |
|---|---|---|
| CN | 204037093 | 12/2014 |
| DE | 29715547 | 10/1997 |
| EP | 0865928 | 9/1998 |
| JP | H0383667 | 4/1991 |
| JP | H069099 | 1/1994 |
| JP | H10310288 | 11/1998 |

* cited by examiner

STALLING OPERATION OF IMAGING DEVICES

BACKGROUND

Imaging devices, such as printers and scanners, can be used for transferring printing data on to a medium, such as paper, by a non-impact process. The printing data can include, for example, a picture or text or a combination thereof, and can be received from a computing device. The imaging device can have an image-forming assembly, such as a printhead of a printer or a scanner, to form an image or text on the medium by precisely delivering small volumes of a printing fluid on to the medium. For printing, a relative movement can be provided between the medium and the image-forming assembly. Usually, at least the medium is provided with a motion with respect to the image-forming assembly.

BRIEF DESCRIPTION OF THE DRAWINGS

The detailed description is provided with reference to the accompanying figures. It should be noted that the description and figures are merely example of the present subject matter and are not meant to represent the subject matter itself.

DETAILED DESCRIPTION

Figure 1:
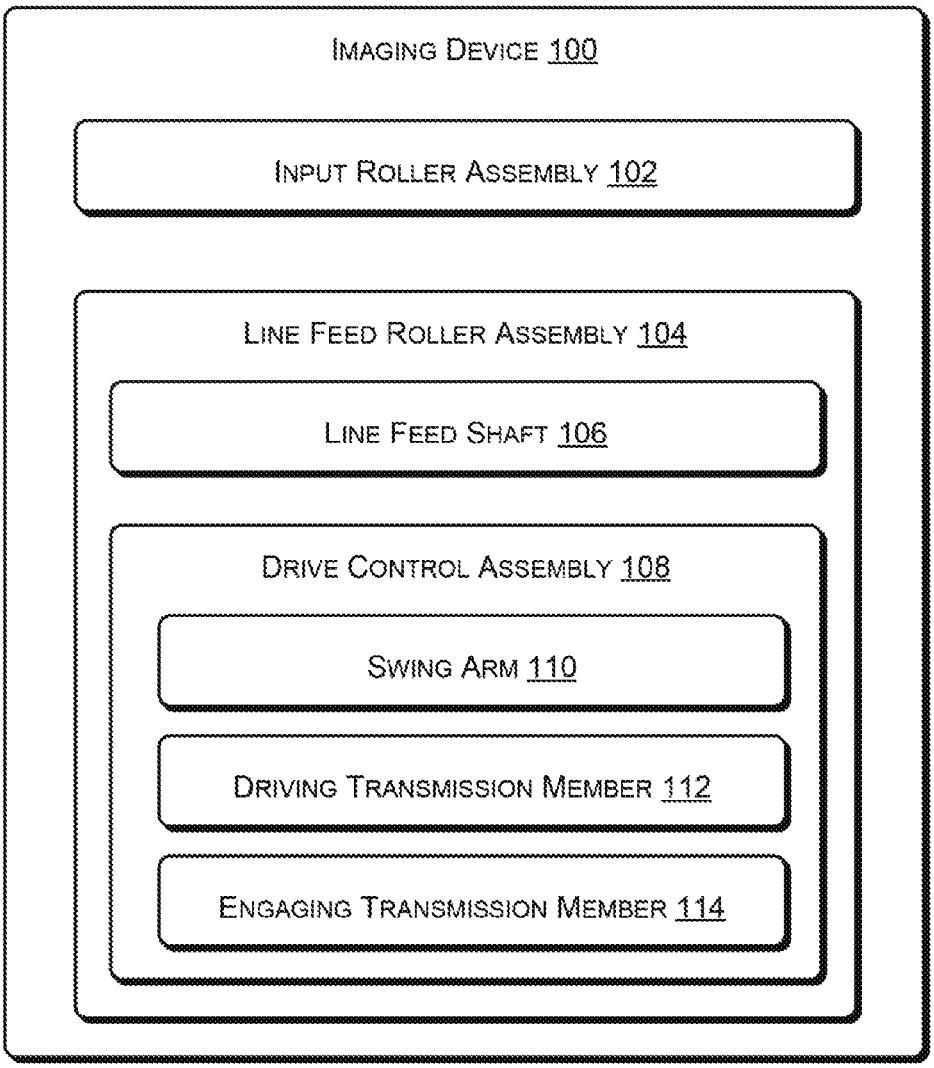
FIG. 1 illustrates a schematic of an imaging device, according to an example.

Generally, during operation of an imaging device, a medium is moved past an image-forming assembly, such as a printhead of a printer or a scanner. The movement of the medium can be achieved by a coordinated action of a delivery mechanism comprising various roller assemblies driven by an actuator and provided along a print path from an input tray to an output area of the imaging device.

With such a construction of the imaging device, in a situation where the operation of the imaging device is to be stalled, for instance, in case the medium is jammed in the print path, the operation of the actuator is stalled to stop the operation of the roller assemblies. Subsequently, the medium is manually pulled out, for example, from the input tray or through an access window at a rear of the imaging device. However, in such a manner of removal, as the medium is pulled manually, the roller assemblies may have to be forcibly actuated, thereby, causing damage to the components of the roller assemblies. In certain other generally used imaging devices, when the medium is pulled, the actuator is operated to slowly rotate a roller assembly in a vicinity of the output area, in the direction of pulling, so that the rollers assemblies move in the same direction for slowly ejecting the jammed medium. Such an operation of the actuator can prevent the components of the roller assemblies from being damaged. However, such an operation of the imaging devices can be achieved when the jammed medium is in the vicinity of the output area of the printer. In addition, when such slow rotating operation of the actuator is to be achieved, the medium has to be removed from the output area and cannot be removed from the input tray or from the rear of the imaging devices.

The present subject matter describes aspects relating to stalling operation of an imaging device, for example, for clearing a medium jammed along a print path of the imaging device during the operation. In an example, the imaging device can be a multi-functional printer, a scanner, a fax machine, or a combination thereof. In said example, the medium can be paper or cloth or any other substrate that can be printed on.

According to said aspect, the operation of the imaging device can be automatically stalled and the medium can be accessed and removed from any accessible point provided in the imaging device. In addition, the present subject matter provides aspects of isolating driving components from driven components to prevent damage to either when the jammed medium is to be removed by pulling the medium. Accordingly, the operation of the imaging device can be stalled and the jammed medium can be drawn out without causing any damage to any component of the imaging device.

The imaging device can include an input roller assembly, a line feed roller assembly, and a drivetrain assembly coupling the line feed roller assembly and the input roller assembly, to guide the substrate along the print path. The line feed roller assembly can be directly coupled to an actuator to obtain a drive therefrom, and can drive the input roller assembly through the drivetrain assembly. According to an aspect, to stall the operation of the imaging device, the line feed roller assembly can be disengaged from the drivetrain assembly to prevent transmission of the drive to the input roller assembly. Accordingly, the line feed roller assembly can selectively provide drive to the input roller assembly.

The line feed roller assembly can be of simple construction to be easily disengaged from the drivetrain assembly and, at the same time, to provide the drive to the drivetrain assembly when engaged. Accordingly, in an example, the line feed roller assembly can include a line feed shaft coupled to the actuator and a drive control assembly mounted on the line feed shaft. The drive control assembly can include a driving transmission member fixedly mounted on the line feed shaft to rotate with the line feed shaft, and a swing arm mounted on the line feed shaft. The swing arm can bear a transition fit on the line feed shaft and can be actuated in unison as well as separately from the line feed shaft. The transition fit can be such that the swing arm, and hence, the drive control assembly can rotate along with the line feed shaft in unison. However, when the movement of the swing arm is stalled, the line feed shaft rotated can still rotate. In other words, the transition fit is such that the swing arm can also rotate separately from the line feed shaft. In addition, the drive control assembly can include an engaging transmission member rotatably mounted on the swing arm and engaged with the driving transmission member.

As explained above, in an example, the disengagement of the roller assemblies can be done to stall the operation of the imaging device to clear the jammed medium. Accordingly, in operation, jamming of the medium along the print path in the imaging device can be detected. The line feed shaft can be rotated to rotate the swing arm of the drive control assembly bearing the transition fit along with the line feed shaft. The rotation or actuation of the line feed shaft can disengage the engaging transmission member mounted on the swing arm from the drivetrain assembly. The disengagement of the engaging transmission member from the drivetrain assembly can disengage the line feed roller assembly from the input roller assembly, thereby, discontinuing advance of the medium along the print path. Therefore, in an example, the construction of the components of the imaging device and regulation of the operation of the components can achieve effective removal of the medium without damage to the components.

The above aspects are further described in the figures and in associated description below. It should be noted that the description and figures merely illustrate principles of the present subject matter. Therefore, various arrangements that encompass the principles of the present subject matter, although not explicitly described or shown herein, can be devised from the description and are included within its scope. Additionally, the word "coupled" is used throughout for clarity of the description and can include either a direct connection or an indirect connection.

FIG. 1 illustrates a schematic of an imaging device 100, according to an example of the present subject matter. In an example, the imaging device 100 can have provisions for stalling operation thereof, for instance, to clear a medium jammed therein. According to an aspect, the imaging device 100 can be constructed in a manner to conveniently remove the medium. Accordingly in an example, the imaging device 100 can include an input roller assembly 102 coupled to a line feed roller assembly 104. Further, the line feed roller assembly 104 can be coupled to an actuator (not shown) to obtain a drive and then can provide the drive to the input roller assembly 102. The input roller assembly 102 can transport a medium from an input tray (not shown) of the imaging device 100 towards an image-forming assembly (not shown) of the imaging device 100 along a print path. The print path can be a path followed by the medium from the input tray where a fresh medium enters the imaging device 100 to an output area where a printed substrate is obtained.

Further, the line feed roller assembly 104 can assist the input roller assembly 102 to carry the medium along the print path. For example, the line feed roller assembly 104 can feed the medium to the image-forming assembly. Accordingly, in an example, the line feed roller assembly 104 can include a line feed shaft 106 and a line feed roller (not shown). The line feed shaft 106 can be coupled to the actuator to obtain drive for the line feed roller assembly 104. The line feed roller can be mounted on the line feed shaft 106 and operably coupled to an auxiliary roller (not shown), for instance, to form a pinch roller assembly to advance the medium towards the image-forming assembly.

According to an aspect, in addition to carrying the medium, the line feed roller assembly 104 can be constructed to selectively provide the drive to the input roller assembly 102. Accordingly, the input roller assembly 102 can be disengagably coupled to the line feed roller assembly 104 through a drivetrain assembly (not shown). In an example, the line feed roller assembly 104 can engage with or disengage from the drivetrain assembly to, in effect, engage with or disengage from the input roller assembly 102. Accordingly, to achieve the engagement and disengagement, the line feed roller assembly 104 can include a drive control assembly 108 mounted on the line feed shaft 106 and responsible for disengaging the line feed roller assembly 104 from the drivetrain assembly, and therefore, the input feed roller assembly 102.

In an example, the drive control assembly 108 can include a swing arm 110 mounted on the line feed shaft 106, a driving transmission member 112 fixedly mounted on the line feed shaft 106, and an engaging transmission member 114 rotatably mounted on the swing arm 110 and engaged with the driving transmission member 112. In operation, to isolate the line feed roller assembly 104 from rest of the components for stalling operation of the imaging device 100, the engaging transmission member 114 can be disengaged from the drivetrain assembly. The engagement and disengagement of the engaging transmission member 114 is explained in further detail with reference to FIG. 3A, FIG. 3B and FIG. 3C.

Figure 2A:
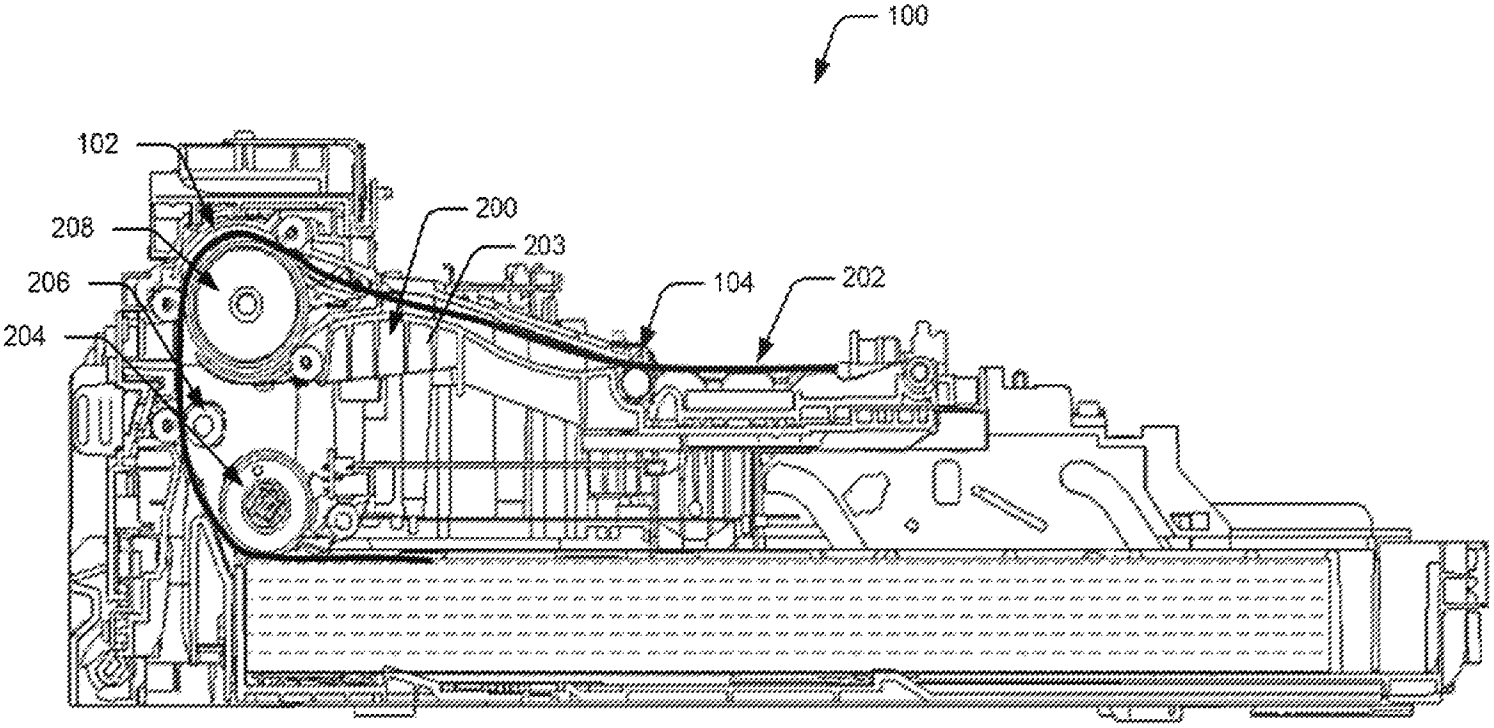
FIG. 2A illustrates a sectional view of the imaging device, according to an example.

FIG. 2A illustrates a sectional view of the imaging device 100, in accordance with an example of the present subject matter. As mentioned previously, the input feed roller assembly 102, the line feed roller assembly 104, and a drivetrain assembly 200 are responsible for the movement of the medium along the print path of the imaging device 100 and feed the medium to an image-forming assembly 202. In an example, the input roller assembly 102 can be provided downstream of the input tray (not shown) of the imaging device 100 and the line feed roller assembly 104 can be provided downstream to the input roller assembly 102. The input tray can receive the fresh medium to be printed on. Further, as shown in FIG. 2A, the drivetrain assembly 200 is encased in side a drivetrain casing 203.

Further, the input roller assembly 102 may include sub-assemblies, such as a pick roller sub-assembly 204, a turn roller sub-assembly 206, and a converging roller sub-assembly 208. In an example, the pick roller sub-assembly 204 can pick the medium from the input tray; the turn roller sub-assembly 206 can change a direction of the medium along the print path; and the converging roller sub-assembly 208 can provide the medium to the line feed roller assembly 104.

Further, as mentioned previously, the input roller assembly 102 can be coupled to the line feed roller assembly 104 through the drivetrain assembly 200. In an example, the drivetrain assembly 200 can be a gear train assembly, a chain-sprocket assembly, a belt-drive assembly, or a combination thereof. In one instance, the drivetrain assembly 200 can include a single drivetrain assembly 200 with drivetrains branching from the drivetrain assembly 200 to couple the sub-assemblies 204, 206, and 208 of the input roller assembly 102. In another instance, each sub-assembly 204, 206, and 208 of the input roller assembly 102 can be provided with separate drivetrain sub-assemblies to couple to the line feed roller assembly 104.

Figure 2B:
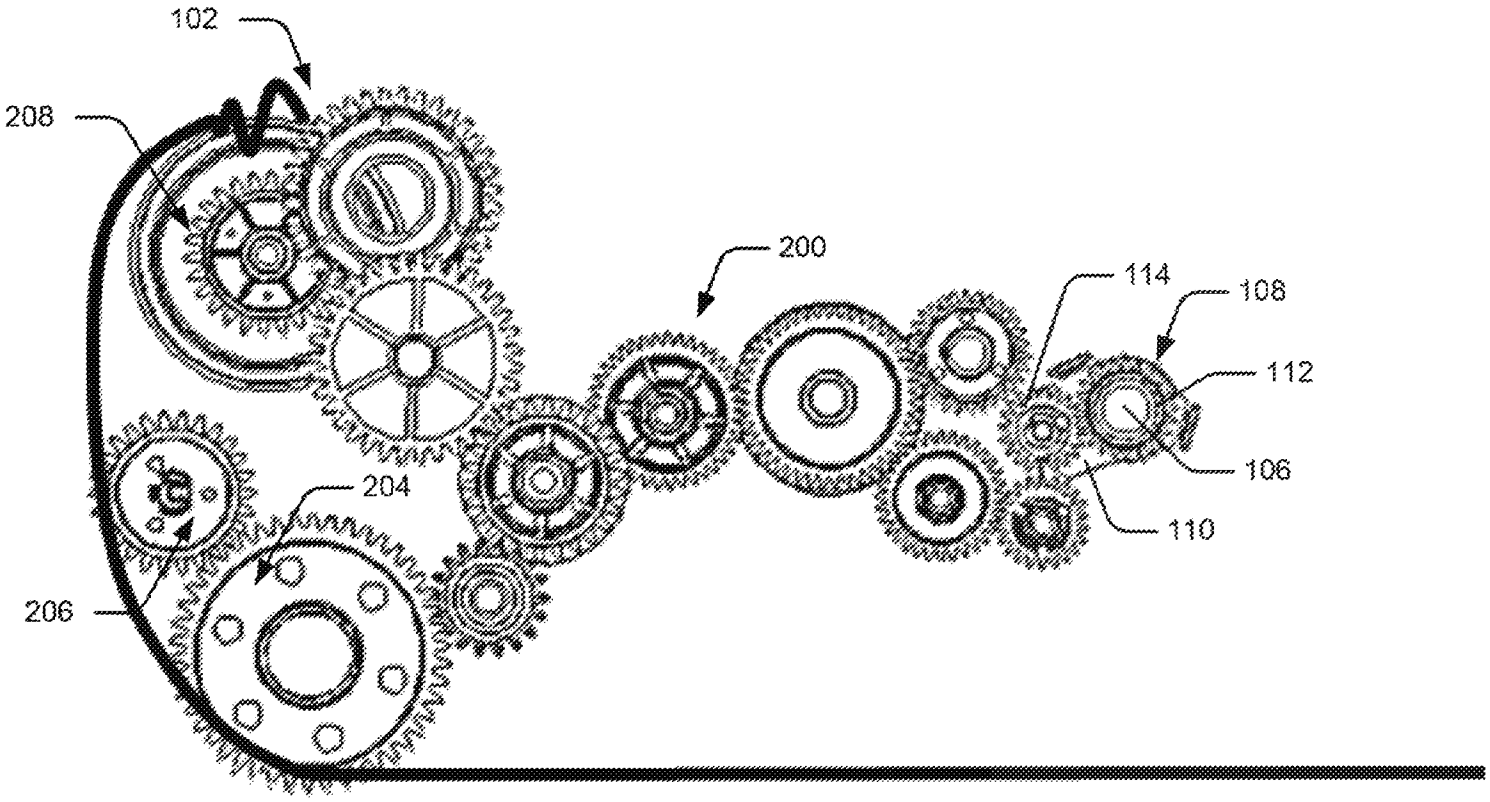
FIG. 2B illustrates a front view of components of the imaging device, according to an example.
Figure 2C:
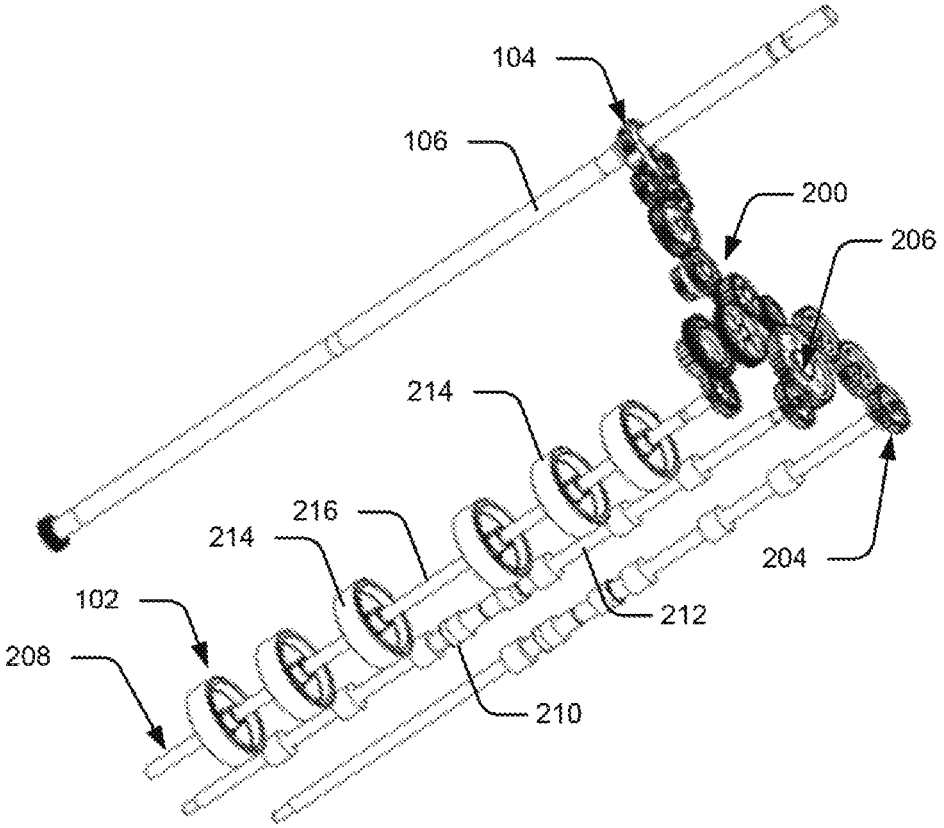
FIG. 2C illustrates a perspective view of the components of the imaging device, according to an example.

The various components of the input roller assembly 102 and the drivetrain assembly 200 are also shown in FIG. 2B and FIG. 2C, according to an example of the present subject matter. FIG. 2B illustrates a front view of the line feed roller assembly 104 coupled to the sub-assemblies 204, 206, and 208 through the single drivetrain assembly 200 according to said example of the present subject matter. FIG. 2C illustrates a perspective view of the line feed roller assembly 104 coupled to the sub-assemblies 204, 206, and 208 of the input roller assembly 102 through the single drivetrain assembly 200, according to said example of the present subject matter. For example, as can be seen in FIG. 2C, rollers 210 of the turn roller sub-assembly 206 can be mounted on a turn roller shaft 212 of the turn roller sub-assembly 206, and rollers 214 of the converging roller sub-assembly 208 can be mounted on a converging roller shaft 216.

Figure 2D:
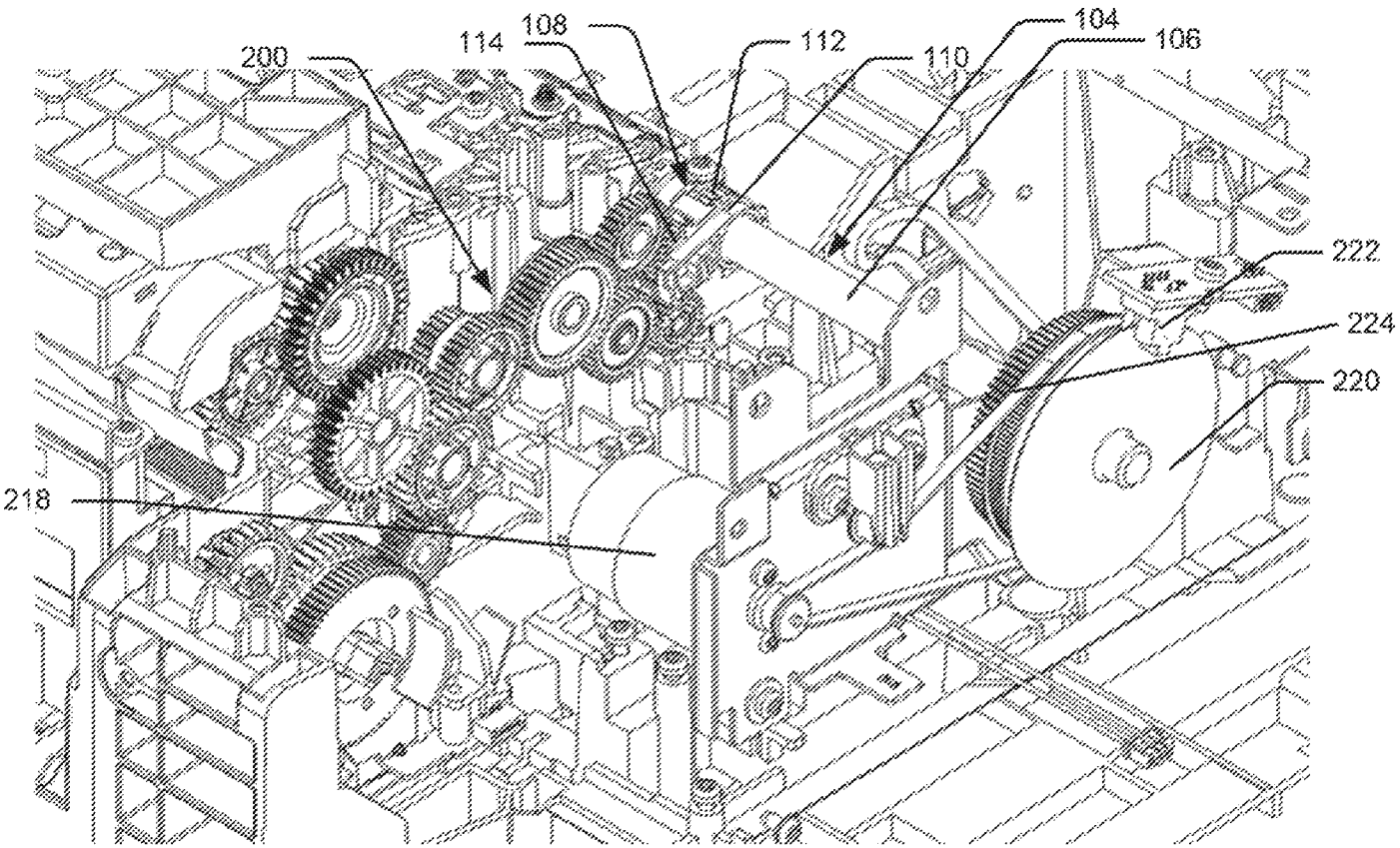
FIG. 2D illustrates a perspective view of the imaging device, according to an example.

Further, to function as the driving component, the line feed roller assembly 104, for instance, the line feed shaft 106 of the line feed roller assembly 104, can be coupled to an actuator 218 as shown in FIG. 2D. FIG. 2D illustrates a perspective view of the imaging device 100, according to an example. For instance, the actuator 218 can be a servo motor or a stepper motor and can be controlled for regulating the movement of the medium along the print path. Accordingly, in an example, the imaging device 100 can include a control device (not shown) to, among other things, precisely regulate the movement of the medium, for instance, past the image-forming assembly 202, to print on the medium. In an example, the control device may be a microprocessor, a microcomputer, a microcontroller, a digital signal processor, a central processing unit, a state machine, a logic circuitry, and/or any other device that can manipulate signals and data based on computer-readable instructions. For instance, the control device can regulate the operation of the actuator 218 to, in turn, regulate the operation of the line feed shaft 106 of the line feed roller assembly 104.

In one example, the line feed shaft 106 of the line feed roller assembly 104 can have an encoder disc 220 fixedly mounted thereon and operably coupled to the control device to exercise the precise rotation control of the line feed shaft 106 and, therefore, the movement of the medium. For instance, the encoder disc 220 can be provided with a sensor element 222 in proximity to determine an angular position of the encoder disc 220 and provide the angular position to the control device. For example, the angular position of the encoder disc 220 can indicate rotation of the line feed shaft 106.

The control device can, based on the angular position of the encoder disc 220, control the actuator 218 and regulate the rotation of the line feed shaft 106, and therefore, the movement of the line feed roller assembly 104. For instance, in the example as shown in FIG. 2D, the encoder disc 220 can coupled to the actuator 218 through a belt drive 224, thereby, coupling line feed shaft 106 to the actuator 218. The control device, using the sensor element 222, can precisely regulate the movement of the encoder disc 220 by accurately determining the angular position of the encoder disc 220, and accordingly, exercise a precise control on the movement of the line feed shaft 106.

Further, in addition to advancing the medium along the print path, a structure of the line feed roller assembly 104 provides for stalling operation of the imaging device 100. In an example, as mentioned previously, the drive control assembly 108 provides for selective engagement and disengagement of the line feed roller assembly 104 from the drivetrain assembly 200. The structure of the drive control assembly 108 provides a simple mechanism for engagement and disengagement of the line feed roller assembly 104 from the drivetrain assembly 200, to regulate the transmission of drive to the input roller assembly 102.

Figure 3A:
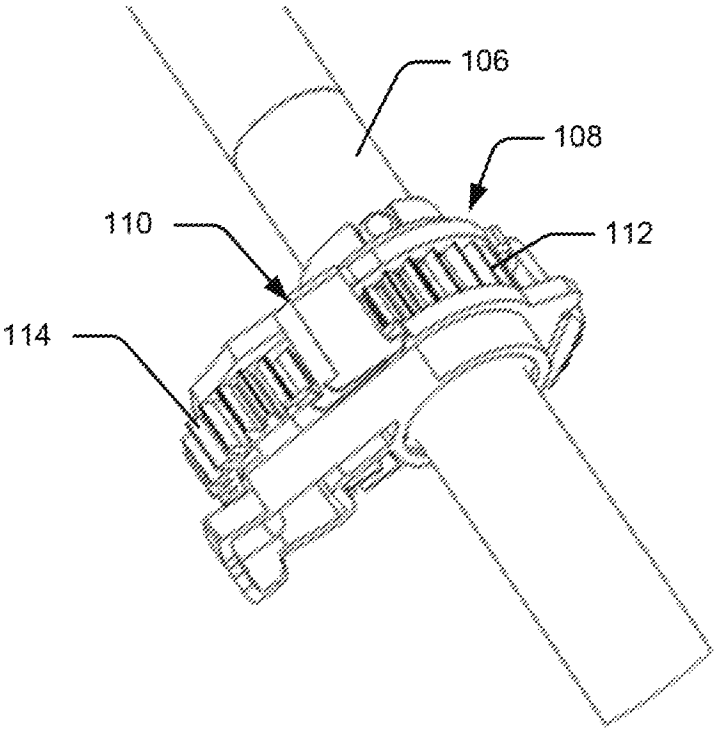
FIG. 3A illustrates a perspective view of a line feed roller assembly of the imaging device, according to an example.
Figure 3B:
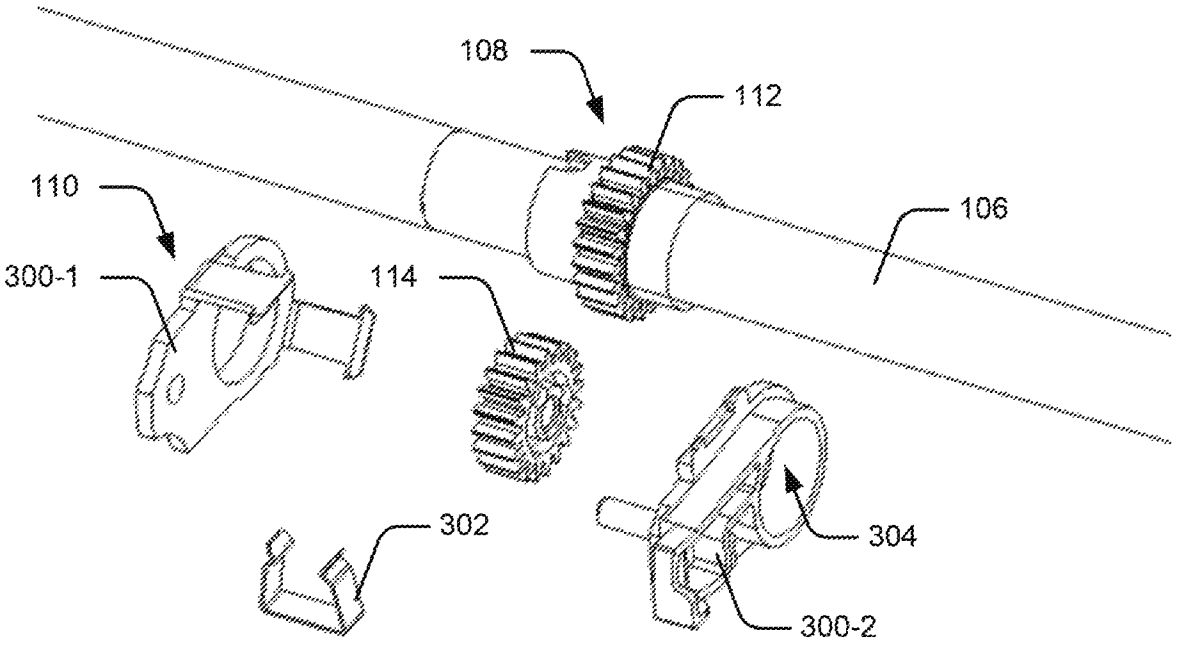
FIG. 3B illustrates an exploded view of the line feed roller assembly, according to an example.
Figure 3C:
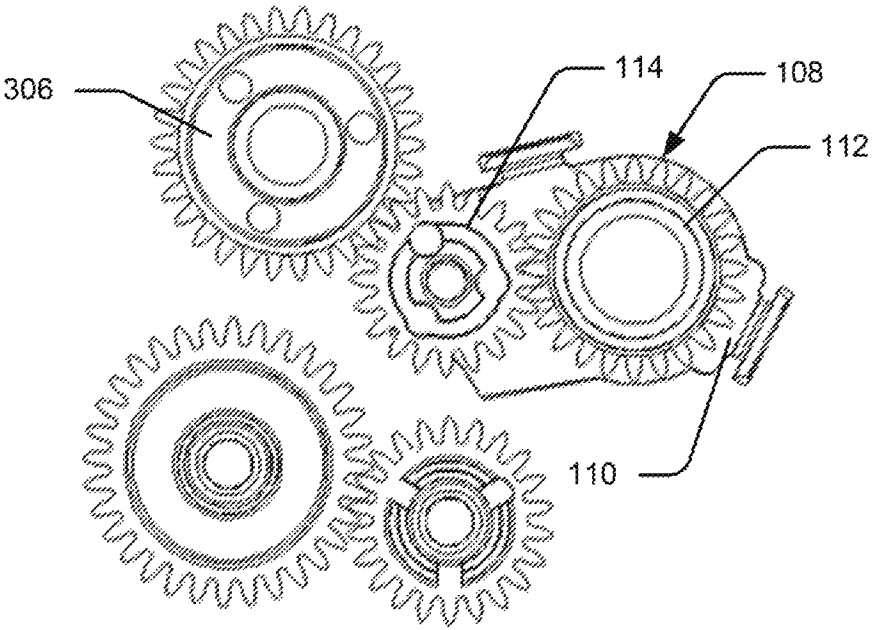
FIG. 3C illustrates a front view of the line feed roller assembly, according to an example.

FIG. 3A, FIG. 3B, and FIG. 3C illustrate constructional details of the drive control assembly 108, in accordance with an example of the present subject matter. In said example, FIG. 3A illustrates a perspective view of the drive control assembly 108 in an assembled state of the line feed roller assembly 104; FIG. 3B illustrates an exploded perspective view of the drive control assembly 108; and FIG. 3C illustrates a front view of the drive control assembly 108 in the assembled state of the line feed roller assembly 104. For the sake of brevity and ease of understanding, FIG. 3A, FIG. 3B, and FIG. 3C are explained in conjunction.

The drive control assembly 108 includes the driving transmission member 112 fixedly mounted on the line feed shaft 106, the swing arm 110 movably mounted on the line feed shaft 106, and the engaging transmission member 114 mounted on the swing arm 110. Therefore, the drive control assembly 108 can be mounted on the line feed shaft 106 by the driving transmission member 112 and the engaging transmission member 114. In operation, the engaging transmission member 114 can be disengaged from the drivetrain assembly 200 to disengage the line feed roller assembly 104 from rest of the components for preventing the transmission of the drive and for stalling operation of the imaging device 100.

Further, in an example, the driving transmission member 112 and the engaging transmission member 114 can correspond to the type of the drivetrain assembly 200. For instance, if the drivetrain assembly 200 is a gear train, the transmission members 112 and 114 can be gears; if the drivetrain assembly 200 is a chain-sprocket assembly, the transmission members 112 and 114 can be sprockets engaged with each other by a chain. However, in another example, the transmission members 112 and 114 may not correspond to the drivetrain assembly 200. For instance, the drivetrain assembly 200 can be a belt-drive assembly and the transmission members 112 and 114 can be gears. In such a case, a shaft of the drivetrain assembly 200 proximal to the engaging transmission member 114, in addition to having a member of the belt-drive assembly, can have a gear to engage with the engaging transmission member 114.

Further, according to an aspect, the swing arm 110 can bear a transition fit on the line feed shaft 106. In other words, the swing arm 110 is mounted on the line feed shaft 106 with such a fit that the swing arm 110, and hence, the drive control assembly 108 can rotate along with the line feed shaft 106 in unison, i.e., as a single unit. However, the swing arm 110 can also rotate separately from the line feed shaft 106. For instance, when the movement of the swing arm 110 is stalled and the line feed shaft 106 is rotated, or when the movement of the line feed shaft 106 is stalled and the swing arm 110 is actuated, a relative motion between the swing arm 110 and the line feed shaft 106 can be achieved.

Further, in an example, the swing arm 110 can be formed as having a plurality of lateral plates 300-1 and 300-2 bound together by a clip element 302. Each of the plurality of lateral plates 300-1 and 300-2 can have a hole 304 formed therein for mounting the swing arm 110 on the line feed shaft 106. For instance, a body of the lateral plate 300-1, 300-2 can define the hole 304 therein. The body of the lateral plate 300-1, 300-2 can be a main portion of the lateral plate 300-1, 300-2 which abuts against the transmission members 112 and 114. In addition, a central axis of the hole 304 can be substantially perpendicular to a plane of the lateral plate 300-1, 300-2 in which the hole 304 is formed.

Further, in an example, a mounting surface of the hole 304 can be lined with a non-friction lining made of an elastic material. In an example, the mounting surface of the hole 304 can be the surface of the hole 304 at which the plate 300-1, 300-2 is mounted on the line feed shaft 106, or in other words, can be the surface of the hole in contact with the line feed shaft 106 in a mounted condition of the plate 300-1, 300-2. In addition, the clip element 302 can be adjustable to adjust a firmness of the transition fit of the swing arm 110 on the line feed shaft 106.

In operation, the transition fit of the swing arm 110 on the line feed shaft 106 provides for a constructionally noncomplex mechanism for disengaging the line feed shaft 106 from the drivetrain assembly 200, and for transmitting the drive to the drivetrain assembly 200 when the engaging transmission member 114 is engaged therewith. For example, in a disengaged state of the engaging transmission member 114, when the line feed shaft 106 is rotated by the actuator 218, for instance in a clockwise direction, as viewed in FIG. 3C, a tight transition fit of the swing arm 110 can make the swing arm 110 to actuate along with the line feed shaft 106. Accordingly, the driving transmission member 112, although engaged to the engaging transmission member 114, may not actuate the engaging transmission member 114. Instead, the engaging transmission member 114 can move with the swing arm 110 and can engage with a member 306 of the drivetrain assembly 200.

Further, in the engaged state of the engaging transmission member 114 with the member 306, the movement of the swing arm 110 is stalled, i.e., the swing arm 110 cannot rotate beyond the member 306. Accordingly, in such a condition, further rotation of the line feed shaft 106, or in other words, rotation of the driving transmission member 112 can be transmitted to the engaging transmission member 114, thereby, providing the drive to the drivetrain assembly 200 through the member 306. Accordingly, in such a state of the engaging transmission member 114, the drive of the actuator 218 from the line feed shaft 106 is transmitted to the input roller assembly 102 to advance the medium along the print path.

To disengage, the actuator 218 can be operated to rotate in an opposite direction to rotate the line feed shaft 106 in a counter-clockwise direction, as viewed in FIG. 3C. Upon such a movement of the line feed shaft 106, the swing arm 110, not finding any resistance to motion along with the line feed shaft 106, can actuate to disengage the engaging transmission member 114 from the member 306. Further, in case, as described above, where the imaging device 100 includes more than one input roller assembly 102, for instance, the input roller assembly 102 having the sub-assemblies 204, 206, and 208, the engaging transmission member 114 can be disengaged from one sub-assembly 204, 206, and 208 and engaged with another by regulating the movement of the line feed shaft 106.

For example, the line feed roller assembly 104 can be disengaged from one sub-assembly 204, 206, and 208 and engaged with another in cases where the line feed roller assembly 104 and the converging roller sub-assembly 208 are to be operated in a reverse direction, for instance, for double-sided printing, but the few of the sub roller assemblies, such as the pick roller sub-assembly 204, are not to be operated. In addition, in such a case where the imaging device 100 includes the sub-assemblies 204, 206, and 208 in the input roller assembly 102, the line feed shaft 106 can be rotated to bring the engaging transmission member 114 in a neutral position in which it is disengaged from all the sub-assemblies 204, 206, and 208.

Therefore, in addition to the construction of the components of the imaging device 100, such as the drive control assembly 108, the operation of the imaging device 100 can be regulated to stall operation of the imaging device 100. In an example, the control device of the imaging device 100 can regulate the operation of the line feed roller assembly 104, for instance, operation of the line feed shaft 106, to isolate the line feed roller assembly 104 from the drivetrain assembly 200 and, therefore, from the input roller assembly 102. For example, the isolation of the line feed roller assembly 104 from the other components can facilitate in removal of a jammed medium without causing damage to the components of the line feed roller assembly 104, the drivetrain assembly 200, the input roller assembly 102, or to the actuator 218, or to any combination thereof.

Figure 4:
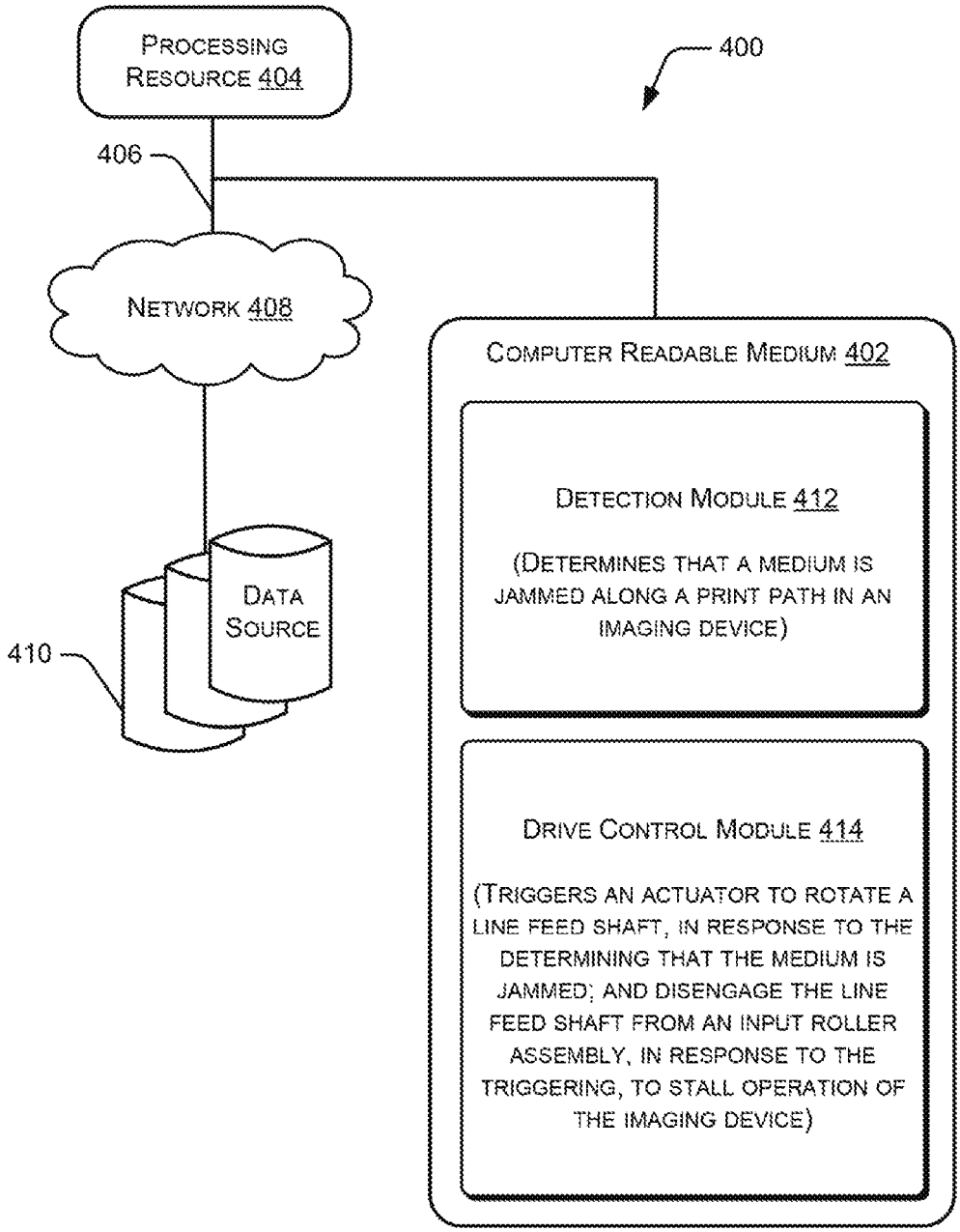
FIG. 4 illustrates a network environment for stalling operation of an imaging device, according to an example.

FIG. 4 illustrates an example network environment 400 using a non-transitory computer readable medium 402 for stalling operation of an imaging device 100, according to an example of the present subject matter. The network environment 400 may be a public networking environment or a private networking environment. In one example, the network environment 400 includes a processing resource 404 communicatively coupled to the non-transitory computer readable medium 402 through a communication link 406.

For example, the processing resource 404 can be a processor, such as the control device of the imaging device 100. The non-transitory computer readable medium 402 can be, for example, an internal memory device or an external memory device. In one example, the communication link 406 may be a direct communication link, such as one formed through a memory read/write interface. In another example, the communication link 406 may be an indirect communication link, such as one formed through a network interface. In such a case, the processing resource 404 can access the non-transitory computer readable medium 402 through a network 408. The network 408 may be a single network or a combination of multiple networks and may use a variety of communication protocols.

The processing resource 404 and the non-transitory computer readable medium 402 may also be communicatively coupled to data sources 410 over the network 408. The data sources 410 can include, for example, databases and computing devices. The data sources 410 may be used by the database administrators and other users to communicate with the processing resource 404.

In one example, the non-transitory computer readable medium 402 can include a set of computer readable instructions, such as a detection module 412 and a drive control module 414. The set of computer readable instructions, referred to as instructions hereinafter, can be accessed by the processing resource 404 through the communication link 406 and subsequently executed to perform acts for network service insertion. In other words, during operation the processing resource 404 can execute the detection module 412 and the drive control module 414.

On execution by the processing resource 404, the detection module 412 can determine whether the medium is jammed in the imaging device 100, for example, at any position along the print path. In response to the determining that the medium is jammed, the drive control module 414 can trigger the actuator 218 to rotate the line feed shaft 106. In response to the triggering, the drive control module 414 can operate the actuator 218 to disengage the line feed shaft 106 from the input roller assembly 102 to discontinue advance of the medium along the print path and stall operation of the imaging device 100. Accordingly, a jam can be detected and the operation of the imaging device 100 stalled, irrespective of the position of the medium along the print path.

In an example, the imaging device 100 can have a plurality of sensor elements deployed along the print path for detecting the position of the medium and movement of the medium along the print path, based on, for instance, a leading edge of the medium. In an example, the detection module 412 can periodically obtain the information regarding the position and movement of the medium and, accordingly, determine whether the medium has been jammed in the print path. For instance, if one of the sensor elements detects that the medium has the same position for more than a predetermined period of time, in such a case, the detection module 412 can determine that the medium is jammed along the print path.

The drive control module 414 can be operably coupled to the actuator 218 for achieving the disengagement of the line feed shaft 106 from the drivetrain assembly 200, and therefore, from the input roller assembly 102. Accordingly, the drive control module 414 can also regulate a selective transmission of the drive to the input roller assembly 102. In one example, in order to control the actuator 218 for regulating the movement of the line feed shaft 106, the drive control module 414 can be operably coupled to cooperate with the encoder disc 220 fixedly mounted on the line feed shaft 106.

The encoder disc 220 can be provided with the sensor element 222 in the proximity to determine the angular position of the encoder disc 220 and provide the angular position to the drive control module 414. Based on the angular position of the encoder disc 220, the drive control module 414 can precisely regulate the movement of the encoder disc 220 by accurately determining the angular position of the encoder disc 220. The precise movement of the encoder disc 220 fixedly mounted on the line feed shaft 106, in turn, allows the drive control module 414 to exercise a precise control on the movement of the line feed shaft 106. Therefore, in this manner, the drive control module 414 can regulate the actuator 218 to control the rotation of the line feed shaft 106, and therefore, the movement of the line feed roller assembly 104.

In an example, the drive control module 414 can rotate the line feed shaft 106 to actuate the swing arm 110 mounted thereon to, in turn, disengage the engaging transmission member 114 mounted on the swing arm 110 from the drivetrain assembly 200, and therefore, from the input roller assembly 102. The construction and operation of the swing arm 110 for disengaging the engaging transmission member 114 is achieved in the same manner as explained with reference to FIG. 3A, FIG. 3B, and FIG. 3C.

Further, according to an aspect, the drive control module 414 can actuate the swing arm 110 to surely disengage the engaging transmission member 114 from the drivetrain assembly 200. In other words, the operation of the drive control module 414 ensures that the engaging transmission member 114 is completely disengaged from the drivetrain assembly 200, such that in case the medium is to be pulled from the imaging device 100, the line feed roller assembly 104 does not sustain any damage.

Accordingly, in an example, the drive control module 414 can rotate the line feed shaft 106 in an engagement direction by a first number of counts to a homing position. The homing position can be a position of the line feed shaft 106 from which the disengagement procedure commences. For instance, in the example, the homing position can be the engaged position of the engaging transmission member 114. In an example, the number of counts can be based on the movement of the encoder disc 220. Further, the engagement direction can be the direction in which the line feed shaft 106 is to be rotated in order to actuate the swing arm 110 to engage the engaging transmission member 114. Accordingly, in the homing position, the engaging transmission member 114 can be engaged with the drivetrain assembly 200.

Subsequently, the drive control module 414 can rotate the line feed shaft 106 in a counter-engagement direction opposite to the engagement direction by a second number of counts. The counter engagement direction can be the direction in which the swing arm 110 is to be actuated to disengage the engaging transmission member 114 from the drivetrain assembly 200, and therefore, the input roller assembly 102. Such operation of the drive control module 414 ensures that the engaging transmission member 114 is, at the outset of disengagement, surely engaged with the drivetrain assembly 200. In the absence of such operation of the drive control module 414, in case the operation of the imaging device 100 is to be stalled, the rotation of the line feed shaft 106 in the counter engagement direction might cause the engaging transmission member 114 to mistakenly engage with another member of the drivetrain assembly 200. For instance, such accidental engagement may occur in cases where the imaging device 100 includes more than one drivetrain assemblies 100 or the drivetrain assembly 200 includes more than one point of engagement to drive the different sub-assemblies 204, 206, and 208 in the input roller assembly 102.

According to an aspect, the second number of counts can be less than the first number of counts. In an example, the first number of counts can be about four times the second number of counts. For instance, the first number of counts by which the line feed shaft 106 is rotated to disengage the engaging transmission member 114 from the drivetrain assembly 200 can be about 800 or greater. On the other hand, the second number of counts by which the line feed shaft 106 is rotated to engage the engaging transmission member 114 with the drivetrain assembly 200 can be in a range of about 180 to 210 counts.

The drive control module 414 can rotate the line feed shaft 106 in the engagement and counter-engagement direction by such number of counts so that, to initiate disengagement, the driving transmission member 112 is surely in an engaged position. Subsequently, while disengaging, the drive control module 414 achieves substantially less number of counts of rotation of the line feed shaft 106 to bring the engaging transmission member 114 in a neutral position where the engaging transmission member 114 is not engaged with any member of the drivetrain assembly 200. In addition, for the same purpose, the drive control module 414 can rotate the line feed shaft 106 in the counter-engagement direction at a speed about one-fifth of a speed of rotating the line feed shaft 106 in the engagement direction. For instance, the drive control module 414 can rotate the line feed shaft 106 in the engagement direction at a speed of about 5 inches per second and can rotate the line feed shaft 106 in the counter-engagement direction at a speed of about 1 inch per second.

Figure 5:
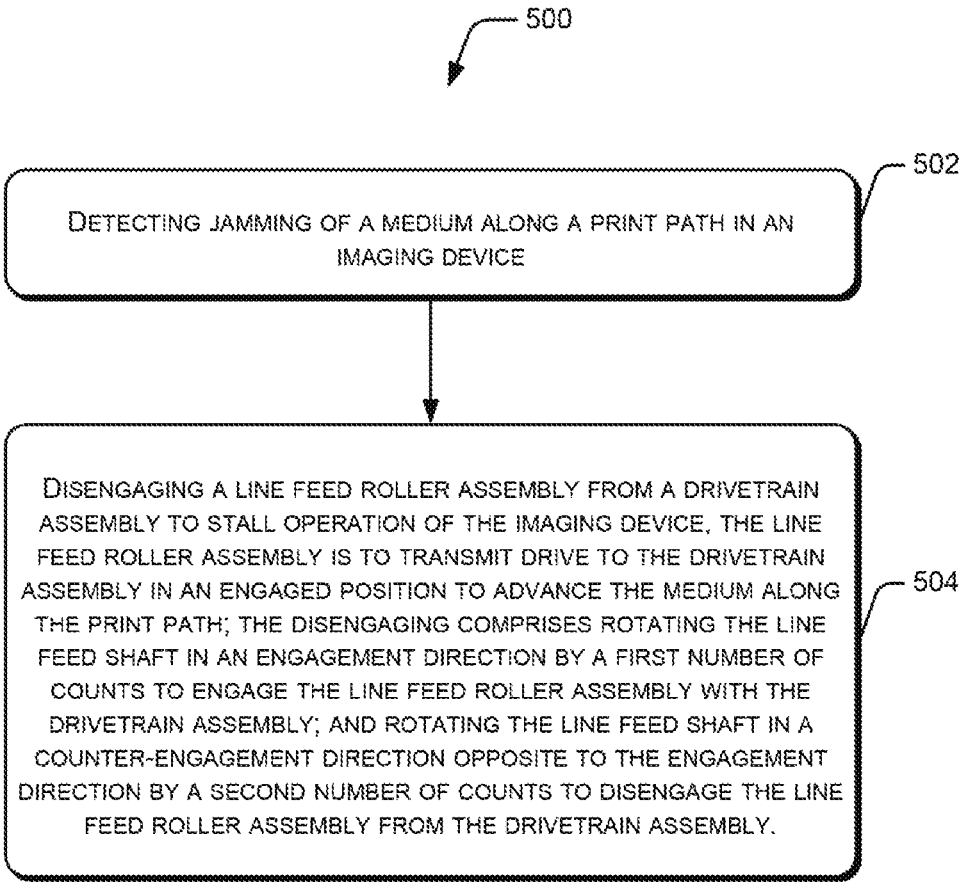
FIG. 5 illustrates a method for stalling operation of an imaging device, according to an example.

Method 500 is described in FIG. 5 for stalling the operation of the imaging device 100, according to an example of the present subject matter. The order in which the method 500 is described is not intended to be construed as a limitation, and any number of the described method blocks can be combined in any appropriate order to carry out the method 500 or an alternative method. Additionally, individual blocks may be deleted from the method 500 without departing from the spirit and scope of the subject matter described herein.

The method 500 can be performed by programmed computing devices, for example, based on instructions retrieved from the non-transitory computer readable medium or non-transitory computer readable media. The computer readable media can include machine-executable or computer-executable instructions to perform all or portions of the described method. The computer readable media may be, for example, digital memories, magnetic storage media, such as a magnetic disks and magnetic tapes, hard drives, or optically readable data storage media.

Referring to FIG. 5, the method 500 may be performed by a control device, such as the control device of the imaging device 100.

At block 502, jamming of a medium in the imaging device 100 is detected, for example, at any position along the print path. In an example, the control device can coordinate with the plurality of sensor elements deployed along the print path. In said example, the position of the medium and movement of the medium along the print path can be determined, based on, for instance, a leading edge of the medium. In an example, the information regarding the position and movement of the medium can be periodically obtained and, accordingly, whether the medium has been jammed can be determined.

At block 504, the line feed roller assembly 104 can be disengaged from the input roller assembly 102, in response to the detection of the jam, to stall operation of the imaging device 100, the line feed roller assembly 104 being to transmit the drive to the drivetrain assembly 200. For example, engaging transmission member 114 of the line feed roller assembly 104 can be disengaged from the drivetrain assembly 200 to disengage the line feed roller assembly 104 and the input roller assembly 102. By such disengagement, the selective transmission of drive to the input roller assembly 102 can be achieved.

In an example, to achieve the disengagement of the engaging transmission member 114 from the drivetrain assembly 200, the line feed shaft 106 can be rotated to actuate the swing arm 110 mounted thereon. The actuation of the swing arm 110 can move the swing arm 110 from the drivetrain assembly 200 and disengage the engaging transmission member 114 mounted on the swing arm 110.

According to an aspect, the swing arm 110 can be operated in such a manner as to ensure that the engaging transmission member 114 is completely disengaged from the drivetrain assembly 200. Therefore, in case the medium is to be pulled from the imaging device 100, the line feed roller assembly 104 does not sustain any damage. Accordingly, in an example, the line feed shaft 106 can be rotated in an engagement direction by a first number of counts to bring the line feed shaft 106 in a homing position and, subsequently, in the counter-engagement direction opposite to the engagement direction by a second number of counts. According to an aspect, the second number of counts can be less than the first number of counts.

The engagement direction can be the direction in which the line feed shaft 106 is to be rotated in order to actuate the swing arm 110 to engage the engaging transmission member 114 and the counter engagement direction can be the direction in which the swing arm 110 is to be actuated to disengage the engaging transmission member 114. Accordingly, in the homing position, the engaging transmission member 114 can be engaged with the drivetrain assembly 200.

Further, in an example, the first number of counts by which the line feed shaft 106 is rotated to engage transmission member 114 from the drivetrain assembly 200 can be about 800 counts, for bringing the line feed shaft 106 in the homing position. On the other hand, the second number of counts by which the line feed shaft 106 is rotated to disengage the engaging transmission member 114 with the drivetrain assembly 200 can be in a range of about 180 to 210 counts.

In addition, for the same purpose, the line feed shaft 106 can be rotated in the counter-engagement direction at a speed about one-fifth of a speed of rotating the line feed shaft 106 in the engagement direction. For instance, in the engagement direction, the line feed shaft 106 can be rotated at a speed of about 5 inches per second, and in the counter-engagement direction, the line feed shaft 106 can be rotated at a speed about 1 inch per second.

Although aspects of stalling of operation of the imaging device 100 have been described in language specific to structural features and/or methods, it is to be understood that the appended claims are not limited to the specific features or methods described. Rather, the specific features and methods are disclosed as examples for the stalling of operation of the imaging device 100.

What is claimed is:

1. An imaging device comprising:

an input roller assembly to transport a medium from an input tray towards an image-forming assembly; and a line feed roller assembly disengagably coupled to the input roller assembly to selectively drive the input roller assembly, the line feed roller assembly comprising:

a line feed shaft coupled to an actuator to:

obtain a drive from the actuator; and disengage from the input roller assembly to discontinue advance of the medium; and a drive control assembly mounted on the line feed shaft to disengage the line feed roller assembly from the input roller assembly to stall operation of the imaging device, the drive control assembly comprising:

a swing arm mounted on the line feed shaft, wherein the swing arm bears a transition fit on the line feed shaft;

a driving transmission member fixedly mounted on the line feed shaft to rotate with the line feed shaft; and an engaging transmission member rotatably mounted on the swing arm and engaged with the driving transmission member, wherein the engaging transmission member is to engage and disengage from the input roller assembly by actuation of the swing arm to selectively drive the input roller assembly.

2. The imaging device as claimed in claim 1, further comprising a drivetrain assembly coupling the line feed roller assembly to the input roller assembly, wherein the line feed roller assembly is disengagably coupled to the drivetrain assembly.

3. The imaging device as claimed in claim 2, further comprising a control device to control the actuator to rotate the line feed shaft, wherein rotation of the line feed shaft is to actuate the swing arm to engage and disengage the engaging transmission member from the drivetrain assembly.

4. The imaging device as claimed in claim 3, wherein the line feed roller assembly comprises an encoder disc mounted on the line feed shaft and operably coupled to the control device, wherein the control device is to control the rotation of the line feed shaft based on an angular position of the encoder disc.

5. The imaging device as claimed in claim 3, wherein the driving transmission member is to rotate with the line feed shaft to drive the engaging transmission member when the engaging transmission member is engaged with the drivetrain assembly.

6. The imaging device as claimed in claim 3, wherein the swing arm is to stall when the engaging transmission member is engaged with the drivetrain assembly, and wherein the line feed shaft is rotatable when the swing arm is stalled.

7. The imaging device as claimed in claim 1, wherein the swing arm comprises:

a plurality of lateral plates, a body of each lateral plate defining a hole therein for being mounted on the line feed shaft, wherein a central axis of the hole is substantially perpendicular to a plane of the lateral plate; and a clip element for binding the plurality of lateral plates, wherein the clip element is adjustable to adjust the transition fit of the swing arm on the line feed shaft.

8. A method comprising:

detecting jamming of a medium in an imaging device; and disengaging a line feed roller assembly from a drivetrain assembly to stall operation of the imaging device of advancement of the medium along a print path, wherein the line feed roller assembly transmits a drive to the drivetrain assembly in an engaged position to advance the medium along the print path and the line feed shaft disengages from the input roller assembly to discontinue advance of the medium, wherein the disengaging comprises:

rotating a line feed shaft of the line feed roller assembly in an engagement direction by a first number of counts to engage the line feed roller assembly with the drivetrain assembly; and rotating the line feed shaft in a counter-engagement direction opposite to the engagement direction by a second number of counts to disengage the line feed roller assembly from the drivetrain assembly, the second number of counts being less than the first number of counts.

9. The method as claimed in claim 8, wherein the first number of counts is about four times the second number of counts.

10. The method as claimed in claim 8, wherein the disengaging comprises rotating the line feed shaft in the counter-engagement direction to actuate a swing arm to engage an engaging transmission member mounted on the swing arm with the drivetrain assembly.

11. A non-transitory computer-readable medium comprising instructions executable by a processing resource to:

determine that a medium is jammed along a print path in an imaging device;

trigger an actuator to rotate a line feed shaft of the imaging device and disengage from the input roller assembly to discontinue advance of the medium, in response to the determining that the medium is jammed; and disengage the line feed shaft from an input roller assembly of the imaging device, in response to the triggering, to discontinue advance of the medium along the print path and stall operation of the imaging device.

12. The non-transitory computer-readable medium as claimed in claim 11 comprising instructions executable by the processing resource to actuate a swing arm mounted on the line feed shaft to disengage an engaging transmission member mounted on the swing arm from a drivetrain assembly, to disengage the line feed shaft from the input roller assembly.

13. The non-transitory computer-readable medium as claimed in claim 12 comprising instructions executable by the processing resource to:

rotate the line feed shaft in an engagement direction by a first number of counts to a homing position, wherein the engaging transmission member mounted on the swing arm is engaged with the drivetrain assembly in the homing position; and rotate the line feed shaft in a counter-engagement direction opposite to the engagement direction by a second number of counts to disengage the engaging transmission member from the drivetrain assembly, the second number of counts being less than the first number of counts.

14. The non-transitory computer-readable medium as claimed in claim 13 comprising instructions executable by the processing resource to rotate the line feed shaft in the counter-engagement direction at a speed about one-fifth of a speed of rotating the line feed shaft in the engagement direction.

15. The non-transitory computer-readable medium as claimed in claim 11 comprising instructions executable by the processing resource to cooperate with an encoder disc mounted on the line feed shaft to regulate rotation of the line feed shaft.

* * * * *